United States Patent [19]

Bennett et al.

[11] 3,932,130

[45] Jan. 13, 1976

[54] INHIBITION OF ALUMINUM CORROSION BY SULFURIC ACID SOLUTIONS

[75] Inventors: Richard H. Bennett; James W. Brockington, both of Richmond, Va.

[73] Assignee: Texaco Inc., New York, N.Y.

[22] Filed: July 3, 1974

[21] Appl. No.: 485,400

[52] U.S. Cl. ..... 21/2.7 R; 21/2.5 R; 148/6.27; 156/22; 252/146; 252/147; 252/387

[51] Int. Cl.$^2$ ..... C23F 11/04; C23G 1/04

[58] Field of Search ..... 21/2.7 R, 2.5 R, 2; 252/387, 146, 147, 151; 156/22; 148/6.27

[56] References Cited

UNITED STATES PATENTS

| | | | |
|---|---|---|---|
| 3,010,854 | 11/1961 | Satterfield | 252/147 X |
| 3,275,562 | 9/1966 | Smith | 252/387 X |
| 3,331,710 | 7/1967 | Lodeesen et al. | 156/22 X |
| 3,779,839 | 12/1973 | Kaihu et al. | 156/22 X |
| 3,887,488 | 6/1975 | Scott et al. | 21/2.7 R X |

*Primary Examiner*—Morris O. Wolk
*Assistant Examiner*—Barry I. Hollander
*Attorney, Agent, or Firm*—T. H. Whaley; C. G. Ries; Douglas H. May, Jr.

[57] ABSTRACT

Corrosion of aluminum metal by sulfuric acid solution is inhibited by addition of soluble fluoride compounds to the acid solutions. Such corrosion inhibition allows use of aluminum as a construction material in process units, particularly sulfuric acid alkylation units, heretofore constructed of heavier and/or more expensive materials.

4 Claims, No Drawings

INHIBITION OF ALUMINUM CORROSION BY SULFURIC ACID SOLUTIONS

BACKGROUND OF THE INVENTION

The present invention relates to a method for inhibiting corrosion of aluminum and its alloys when placed in contact with strong sulfuric acid solutions. More particularly, the present invention relates to dissolving corrosion inhibiting amounts of fluoride containing compounds in sulfuric acid solutions containing from about 0–20 wt. percent water, thereby inhibiting corrosion of aluminum metal in contact with such sulfuric acid solutions.

It is well-known that aluminum and aluminum alloys are subject to corrosion when placed in contact with strong sulfuric acid solutions. For this reason, aluminum is not commonly used as a material of construction in situations where prolonged contact of the aluminum with strong sulfuric acid solutions may be expected.

One particular application wherein materials of construction are subjected to prolonged contact with strong sulfuric acid solutions is in a sulfuric acid catalyzed light olefin alkylation process. In such a process, carbon steel is commonly employed as a material of construction and shows good corrosion resistance of sulfuric acid solutions of from about 87 to 98 weight percent $H_2SO_4$ at temperatures below about 40°C. The corrosion resistance of carbon steel to acids other than $H_2SO_4$ and at temperatures above about 40°C may decrease sharply. For instance, in processes for alkylating light olefins with isoparaffin hydrocarbons, such as disclosed in U.S. Pat. No. 3,231,633, wherein the acid catalyst comprises a mixture of sulfuric acid and fluorosulfuric acid, carbon steel may undergo moderate to severe corrosion in the presence of such mixed acid catalyst. Particularly, in alkylation processes employing acid catalysts comprising mixtures of sulfuric and fluorosulfonic acid, the fluorosulfonic acid must be removed from the spent acid catalyst prior to regeneration of the remaining spent sulfuric acid. One means for separating fluorosulfonic acid is to treat the spent catalyst at an elevated temperature in the neighborhood of 100°C at a reduced pressure. Under these conditions the fluorosulfonic acid breaks down to form hydrogen fluoride which is recovered as a vapor. At elevated temperature, such as 100°C, carbon steel may undergo moderate to severe corrosion in the presence of either strong sulfuric acid solutions or acid mixtures of sulfuric acid and fluorosulfonic acid. Consequently, other materials of construction than carbon steel must be used in processes and systems wherein such material will be in prolonged contact with mixtures of sulfuric acid and fluorosulfonic acid or with strong sulfuric acid solutions at elevated temperatures.

Specially formulated alloys, such as Hastelloy C and Monel 400 are known to have superior corrosion resistance in acid environments; additionally, lead is commonly used in an environment where contact with sulfuric acid may be expected. These metals are, however, expensive and difficult to fabricate.

SUMMARY OF THE INVENTION

Now, according to the present invention we have discovered a method for imparting resistance to aluminum and aluminum alloys when in prolonged contact with sulfuric acid solutions containing from about 0 to 20 weight percent water.

In a preferred embodiment a soluble compound containing fluoride is dissolved in said sulfuric acid solution to provide a fluoride concentration of at least 300 ppm, and more desirably 3000 ppm and higher in the acid solution. The presence of such fluoride in the sulfuric acid solution serves to substantially retard corrosion of aluminum in contact therewith, and higher fluoride concentrations in the range of 10,000–25,000 ppm essentially prevent corrosion of the aluminum.

One major advantage of the present invention is that aluminum may be effectively used as a material of construction in systems wherein the aluminum will be in contact with sulfuric acid solutions containing from about 0 to 20 weight percent water, and at temperatures up to about 200°C. Thus, aluminum may be used in many situations where carbon steel would fail. Aluminum is relatively inexpensive and easy to fabricate compared to other acid resistant alloys and metals having suitable corrosion resistance to hot sulfuric acid solutions.

DETAILED DESCRIPTION OF THE INVENTION

During experiments to determine materials of construction which would be corrosion resistant to spent alkylation catalysts comprising $H_2SO_4$, $HFSO_3$, and $H_2O$ as well as alkylation by products, it was unexpectedly discovered that aluminum was very resistant to corrosion by the hot, c.a. 100°C, spent acid. This discovery was particularly unexpected at it is well-known that aluminum undergoes corrosive attack by sulfuric acid, even though it has been disclosed that aluminum is corrosion resistant to boiling fluorosulfonic acid in the absence of water and sulfuric acid. For instance, see J. N. Brazier and A. A. Woolf, *Journal Chemical Society*, "The Reactivity of Fluorosulphuric Acid and Metals," (1967), p. 99.

The discovery of this unexpected corrosion resistance to aluminum was followed by additional experiments which developed the conditions under which aluminum could be made corrosion resistant in the presence of sulfuric acid solutions comprising 0–20 weight percent water and containing dissolved fluoride containing compounds.

Aluminum which may be treated by the method of the present invention includes pure aluminum and commercial grades of aluminum as well as aluminum alloys. Examples of commercial grades of aluminum which may be treated to impart corrosion resistance thereto by the method of the present invention include (ASME) grades 3003, 2SF, 7024 and 6061-T6.

Aluminum, when treated according to the method of the present invention, is corrosion resistant in strong sulfuric acid solutions at temperatures from below 0°C to about 200°C. Water content of such strong sulfuric acid solution may range from about 0 weight percent to about 20 weight percent. According to the present invention, as the water content of the sulfuric acid increases, higher concentrations of fluoride containing compounds are required to impart corrosion resistance to aluminum in contact with the sulfuric acid solution. In sulfuric acid solutions containing about 50 weight percent water, fluoride will not impart corrosion resistance to aluminum in contact with such sulfuric acid solution at a temperature of about 100°C. However, at 20 weight percent water in sulfuric acid solution, 3000 ppm of fluoride imparts substantial corrosion resistance to aluminum at 100°C.

Fluorine compounds which are useful for imparting corrosion resistance to aluminum in contact with sulfuric acid solutions are those fluorine compounds which are soluble in the sulfuric acid solutions. For example, $HFSO_3$, HF, LiF, NaF, KF, $CaF_2$, $MgF_2$, RbF, CsF, $NH_4F$, $SrF_2$, $BaF_2$, $PbF_2$, etc. A fluorine compound which is very effective in the method of the present invention is sodium fluoride. Particularly preferred as a fluorine compound for use in the present invention is fluorosulfonic acid ($HFSO_3$). In order to impart substantial corrosion resistance, the concentration of fluoride in the sulfuric acid solution must be at least 300 ppm, and preferably is 3000 ppm or more. As stated above, the concentration of fluoride required increases with increasing water content of the sulfuric acid solution. The mechanism by which fluorine compounds impart corrosion resistance to aluminum in contact with strong sulfuric acid solutions is not completely understood and we do not wish to be bound by any theory presented here. One suggested mechanism, which is currently unproved, is that fluoride ion from the dissolved fluorine containing compound reacts to form a continuous coating of aluminum fluoride on the surface of the aluminum in contact with the sulfuric acid and provides protection against corrosion for the underlying aluminum. Aluminum fluoride is, however, soluble in warm water and as the temperature or amount of water in the sulfuric acid solution increases, the aluminum fluoride film will tend to dissolve. This dissolution of the aluminum fluoride film can be counteracted to a great extent by increasing the concentration of fluoride dissolved in the sulfuric acid solution. At temperatures of about 100°C, and sulfuric acid solution water concentrations above about 20 weight percent however, the aluminum fluoride film dissolves as fast as it is formed. Consequently, the corrosion rate of the aluminum increases rapidly as these conditions are exceeded.

In order to further demonstrate the present invention, the following examples showing specific embodiments of the present invention are included. These examples are for the purpose of demonstration only and not as limitation upon the scope of the invention which is set out in the appended claims.

Experiments were originally undertaken to determine preferable materials of construction for an acid digester vessel to be used in the separation of $HFSO_3$ from spent alkylation catalyst comprising $HFSO_3$, $H_2SO_4$, $H_2O$ and acid oil impurities. Separation of $HFSO_3$ from spent catalyst in such an acid digester vessel is accomplished by treating the spent acid at high temperatures and reduced pressures thereby converting $HFSO_3$ to HF. The HF is recovered as a vapor from the acid digester vessel.

Corrosion tests were performed on several metals which were potential candidates as materials of construction for the acid digester vessel. These corrosion tests were performed using coupons of the selected metals suspended in a teflon reactor vessel equipped with a closed top, thermowell, mixer, and external heating means. Coupons of the metals to be tested were polished to remove surface defects and weighed prior to use. Upon completion of the corrosion tests, the coupons were dried and weighed to determine the weight of metal lost. This metal loss was converted mathematically from grams to mils per year of metal thickness lost. Subsequent to the corrosion tests, the metal coupons were subjected to metallurgical examination to determine visible cracking, pitting and evidence of general corrosive attack.

EXAMPLE I

In the first experiment, coupons of selected metals to be tested for corrosion resistance were prepared and installed in the teflon lined reactor vessel, wherein the coupons were contacted with an acid solution comprising 83.83 weight percent $H_2SO_4$, 14.35 weight percent $HFSO_3$ and 1.8 weight percent water, under conditions of mild mixing, at a temperature of 100°C for a period of 96 hours. Results of this first experiment are shown in Table I below:

TABLE I

CORROSION OF METALS IN CONCENTRATED ACID COMPRISING $H_2SO_4$ and $HFSO_3$

| Run | Coupon Material | Run Length (hrs.) | Acid Composition-Wt. % $H_2SO_4$ wt. % | $HFSO_3$ wt. % | $H_2O$ wt. % | emp °C | Coupon initial wt.(gm) | Coupon final wt.(gm) | Coupon weight loss (gm) | Corrosion Rate (mils/year) |
|---|---|---|---|---|---|---|---|---|---|---|
| 1 | Carbon Steel | 96 | 83.84 | 14.35 | 1.8 | 100 | 7.1230 | 6.8637 | 0.2593 | 131. |
| 2 | Hastelloy C | 96 | 83.84 | 14.35 | 1.8 | 100 | 8.8271 | 8.8202 | 0.0069 | 3.1 |
| 3 | Lead | 96 | 83.84 | 14.35 | 1.8 | 100 | 18.0183 | (Coupon dissolved) | | |
| 4 | Monel 400 | 96 | 83.84 | 14.35 | 1.8 | 100 | 8.4815 | 8.4120 | 0.0695 | 31 |
| 5 | 3003 Aluminum[1] | 96 | 83.84 | 14.35 | 1.8 | 100 | 2.5784 | 2.5782 | 0.0002 | 0.3 |

[1]3003 Aluminum contains about—0.20 wt.% Copper; 1.2% Manganese, 0.1% Zn; 0.6% Si; 0.7% Fe: "Metal Handbook," 8th Edition, Vol. I, Taylor Lyman, Editor (1961), p.917.

From Table I, it can be seen that the 3003 Aluminum, which is a commercial construction grade aluminum demonstrated superior corrosion resistance to the hot acid solution over the other metals tested. This result was unexpected, since aluminum is not recommended for use in the presence of sulfuric acid. The other metals tested, carbon steel, lead, Hastelloy C and Monel 400 are commonly used materials of construction showing good corrosion resistance to sulfuric acid. Metallurgical inspection of the aluminum coupon failed to show any signs of cracking or pitting.

EXAMPLE II

In view of the corrosion resistance of the 3003 Aluminum to the acid mixture employed in Example I, another experiment was performed to demonstrate corrosion resistance of various grades of aluminum and other selected metals to a spent alkylation catalyst similar to that which would be encountered in a commercial process. Spent acid catalyst was obtained by reacting isobutane with butylene in the presence of an acid catalyst comprising 83.84 weight percent $H_2SO_4$, 14.35 weight percent $HFSO_3$ and 1.8 weight percent water. The alkylation reaction was continued until the acid catalyst's titrateable acidity had decreased from an original 19.16 milliequivalents per gram to a spent acid acidity of 18.0 milliequivalents per gram. Coupons of the metals to be tested were installed in the teflon lined reactor wherein they were contacted with the spent acid under conditions of mild mixing, at a temperature of 100°C for a period of 90 hours. Operating conditions and tests results of this experiment are shown in Table II below:

TABLE II

CORROSION OF METALS IN SPENT ALKYLATION ACID COMPRISING $H_2SO_4$ and $HFSO_3$

| Run | Coupon Material | Run Length (hrs) | Acid Strength (meg/g) | $H_2O$ in Spent Acid wt. % | Temp. °C | Coupon initial wt. gm | Coupon final wt. gm | Coupon wt. loss gm | Corrosion Rate mils/yr. |
|---|---|---|---|---|---|---|---|---|---|
| 6 | Carbon Steel | 90 | 18.0 | 4 | 100 | 6.8637 | 6.7391 | 0.1246 | 67 |
| 7 | Hastelloy C | 90 | 18.0 | 4 | 100 | 8.8202 | 8.8175 | 0.0027 | 1.3 |
| 8 | Monel 400 | 90 | 18.0 | 4 | 100 | 8.4120 | 8.3438 | 0.0602 | 33 |
| 9 | 3003 Aluminum | 90 | 18.0 | 4 | 100 | 2.5782 | 2.5785 | (0.0003) (gain) | — |
| 10 | 2SF Al[1] | 90 | 18.0 | 4 | 100 | 3.1446 | 3.1445 | 0.0001 | 0.2 |
| 11 | 2024 Al[1] | 90 | 18.0 | 4 | 100 | 2.9679 | 2.9675 | 0.0004 | 0.6 |
| 12 | 6061 Al[1] | 90 | 18.0 | 4 | 100 | 2.5208 | 2.5203 | 0.0005 | 0.8 |

[1]2SF(or1100) Aluminum contains about 1.0% Si + Fe, 0.2% Cu, 0.05% Mn, 0.10% Zn; 2024 Aluminum contains about 4.5% Cu, 0.6% Mn, 1.5% Mg; and 6061 Aluminum contains about 0.6% Si, 0.27% Cu, 1.0% Mg, 0.2% Cr, 0.7% Fe, 0.15% Mn, 0.25% Zn, 0.15% Ti:

Reference: "Metal Handbook", 8th Edition, Vol. I, Taylor Lyman, Editor (1961), p. 917.

Examination of the results contained in Table II show that all tested grades of aluminum (except 3003 Aluminum) are more corrosion resistant to the hot spent acid catalyst than Carbon Steel, Hastelloy C or Monel 400. Results for the 3003 Aluminum indicate a weight gain for the test coupon, which is probably due to an error in weighing the coupon.

In view of the commercial grades of aluminum showing superior corrosion resistance to rather concentrated mixtures of $H_2SO_4$ and $HFSO_3$, additional experiments were performed to determine (a) the effect of increased water in the acid solution upon corrosion resistance to aluminum, (b) whether other compounds other than $HFSO_3$, containing fluorine would impart sulfuric acid corrosion resistance to aluminum, and (c) the minimum concentration of fluoride which imparts sulfuric acid corrosion resistance to aluminum. Results of these experiments are shown in Tables III, IV, and V below.

TABLE III

CORROSION OF ALUMINUM IN $H_2SO_4$ - $HFSO_3$ - $H_2O$ SYSTEM

| Run | Coupon Material | Run Length (hrs.) | Temp. °C | Acid Composition - wt. % $H_2SO_4$ | $HFSO_3$ | $H_2O$ | Coupon initial wt. (gm) | Coupon Final wt. (gm) | Coupon weight loss (gm) | Corrosion Rate (mil/year) |
|---|---|---|---|---|---|---|---|---|---|---|
| 13 | 6061-T6 Aluminum | 96 | 100 | 83.84 | 14.35 | 1.81 | 2.5784 | 2.5782 | 0.0002 | 0.3 |
| 17 | 6061-T6 Aluminum | 113 | 100 | 76.85 | 13.15 | 10 | 2.2520 | 2.2513 | 0.0007 | 0.4 |
| 18 | 6061-T6 Aluminum | 113 | 100 | 76.85 | 13.15 | 10 | 2.4764 | 2.4761 | 0.0003 | 0.2 |
| 19 | 6061-T6 Aluminum | 90 | 100 | 68.31 | 11.69 | 20 | 1.6965 | 1.6989 | 0.0024 | wt. gain |
| 20 | 6061-T6 Aluminum | 90 | 100 | 68.31 | 11.69 | 20 | 1.6850 | 1.6894 | 0.0044 | wt. gain |
| 21 | 6061-T6 Aluminum | 2 | 25 | 42.69 | 7.31 | 50 | 2.0201 | 1.7230 | 0.2971 | 11,226 |

In order to have a basis for comparison of the results reported in Table III, above, a second set of corrosion tests was performed on aluminum employing acid solutions containing only $H_2SO_4$ and water. The water concentration in these acid solutions was varied from 2.1 to 50 weight percent. Operating conditions and results of these corrosion tests are shown in Table IV below.

TABLE IV

CORROSION OF ALUMINUM IN $H_2SO_4$ - $H_0$ SYSTEM

| Run | Coupon Material | Run Length Hrs. | Temp. °C | Acid Composition $H_2SO_4$ wt.% | $H_2O$ wt.% | Coupon initial weight wt.(gm) | Coupon final weight wt. gm | Coupon weight loss wt. gm | Corrosion Rate (mil/year) |
|---|---|---|---|---|---|---|---|---|---|
| 22 | 6061-T6 Aluminum | 118 | 100 | 97.9 | 2.1 | 2.266 | 2.237 | 0.029 | 16.8 |
| 23 | 6061-T6 | 118 | 100 | 97.9 | 2.1 | 2.480 | 2.463 | 0.017 | 8.6 |

TABLE IV-continued

CORROSION OF ALUMINUM IN $H_2SO_4$ - $H_2O$ SYSTEM

| Run | Coupon Material | Run Length Hrs. | Temp. °C | Acid Composition $H_2SO_4$ wt.% | Acid Composition $H_2O$ wt.% | Coupon initial weight wt.(gm) | Coupon final weight wt. gm | Coupon weight loss wt. gm | Corrosion Rate (mil/year) |
|---|---|---|---|---|---|---|---|---|---|
| 24 | Aluminum 6061-T6 | 117 | 100 | 97.9 | 2.1 | 2.2513 | 2.2292 | 0.0221 | 12.8 |
| 25 | Aluminum 6061-T6 | 117 | 100 | 97.9 | 2.1 | 2.4761 | 2.4586 | 0.0175 | 9.2 |
| 26 | Aluminum 6061-T6 | 117 | 100 | 97.9 | 2.1 | 2.5012 | 2.4891 | 0.0121 | 6.3 |
| 39 | Aluminum 6061-T6 | 94 | 100 | 95.2 | 4.8 | 2.3540 | 2.1103 | 0.2442 | 168 |
| 40 | Aluminum 6061-T6 | 94 | 100 | 95.2 | 4.8 | 2.4673 | (Extensive Coupon Corrosion) | | |
| 27 | Aluminum 6061-T6 | 0.2 | 100 | 88.3 | 11.7 | 2.2292 | (Coupon Dissolved) | | |
| 28 | Aluminum 6061-T6 | 0.2 | 100 | 88.3 | 11.7 | 2.4586 | (Coupon Dissolved) | | |
| 29 | Aluminum 6061-T6 | 0.2 | 100 | 88.3 | 11.7 | 2.4891 | (Coupon Dissolved) | | |
| 30 | Aluminum 6061-T6 | 0.2 | 25 | 50 | 50 | 1.7230 | 1.6850 | 0.038 | 166 |

From Table III it can be seen that corrosion resistance of aluminum to $H_2SO_4$ - $HFSO_3$ - $H_2O$ solutions is very good up to 20 weight percent water. The results for the 20 weight percent water solutions (Runs 19 and 20) are not conclusive, as the aluminum coupons showed a weight gain rather than loss at the conclusion of the corrosion test. This indicates an error in weighing the coupons, or buildup of Al-F film on the surface. However, visual examination of the coupons from Runs 19 and 20 indicate that corrosion was not severe. In Run 21 of Table III, where the $H_2SO_4$-$HFSO_3$ acid solution comprised 50 weight percent water, corrosion of the aluminum coupon was very severe, thus indicating that aluminum is not a satisfactory construction material for contact with dilute $H_2SO_4$-$HFSO_3$ solutions.

In Table IV it is seen that aluminum experiences moderately high corrosion rates (6.3–16.8 mil/year) in concentrated $H_2SO_4$ solutions containing 2.1% water. In $H_2SO_4$ solutions containing 4.8 weight percent water, corrosion of the aluminum coupon was substantial (168 + mils/year) and at 11.7 weight percent water the aluminum coupons dissolved rapidly. Corrosion of aluminum by dilute $H_2SO_4$ solution (50 weight percent water) was substantially less than for a $H_2SO_4$ solution containing 11.7 weight percent water, and approximately the corrosion rate of $H_2SO_4$ solution containing only 4.8 weight percent water.

From a study of the results shown in Tables III and IV it is apparent that aluminum shows good corrosion resistance to $H_2SO_4$-$HFSO_3$ acid solutions containing up to 20 weight percent water and a substantial weight percent $HFSO_3$. Further, aluminum in contact with $H_2SO_4$ solutions containing very low water concentrations (2.1 weight percent) suffers moderate corrosion. At water concentrations of 4.8–50 weight percent, aluminum in contact with $H_2SO_4$ solutions undergoes substantial corrosion.

EXAMPLE III

An Experiment was undertaken to demonstrate that ionizable fluoride compounds other than $HFSO_3$, are effective to prevent corrosion of aluminum in the presence of $H_2SO_4$ solutions. In this experiment, three series of corrosion tests were performed upon aluminum coupons using $H_2SO_4$ solutions containing about 2.1 weight percent water, 4.8 weight percent water and about 10 weight percent water. In each series of corrosion tests at a particular water concentration, the concentration of fluoride was varied to determine the minimum amount of fluoride required to impart corrosion resistance to the aluminum coupons. Sodium fluoride was used as the source of fluoride in this experiment to demonstrate that sources of fluoride other than $HFSO_3$ are effective to impart corrosion resistance to aluminum in contact with $H_2SO_4$ solutions. Results of this experiment are shown in Table V, below:

TABLE V

CORROSION OF ALUMINUM IN $H_2SO_4$ - $H_2O$ SYSTEM CONTAINING VARYING AMOUNTS OF IONIZABLE SODIUM FLUORIDE

| Run | Coupon Material | Run Length Hrs. | Temp. °C | Acid Composition $H_2SO_4$ wt. % | Acid Composition $H_2O$ wt. % | Fluoride ppm | Coupon initial wt. gm | Coupon final wt. gm | Coupon weight loss gm | Corrosion Rate (mil/yr) |
|---|---|---|---|---|---|---|---|---|---|---|
| 22 | 6061-T6 Aluminum | 118 | 100 | 97.9 | 2.1 | -0- | 2.266 | 2.237 | 0.029 | 16.8 |
| 23 | 6061-T6 Aluminum | 118 | 100 | 97.9 | 2.1 | -0- 2.480 | 2.463 | 0.017 | 8.6 | |
| 24 | 6061-T6 Aluminum | 117 | 100 | 97.9 | 2.1 | -0- | 2.2513 | 2.2292 | 0.021 | 12.8 |
| 25 | 6061-T6 Aluminum | 117 | 100 | 97.9 | 2.1 | -0- | 2.4761 | 2.4586 | 0.0175 | 9.2 |
| 26 | 6060-T6 Aluminum | 117 | 100 | 97.9 | 2.1 | -0- | 2.5012 | 2.4891 | 0.0121 | 6.3 |
| 43 | 6061-T6 Aluminum. | 64 | 100 | 97.9 | 2.1 | 10(NaF) | 2.5215 | 2.5112 | 0.0103 | 9.7 |
| 44 | 6061-T6 Aluminum | 64 | 100 | 97.9 | 2.1 | 10(NaF) | 2.5050 | 2.4904 | 0.0146 | 14.0 |

TABLE V-continued

CORROSION OF ALUMINUM IN $H_2SO_4$ - $H_2O$ SYSTEM CONTAINING VARYING AMOUNTS OF IONIZABLE SODIUM FLUORIDE

| Run | Coupon Material | Run Length Hrs. | Temp. °C | Acid Composition $H_2SO_4$ wt. % | Acid Composition $H_2O$ wt. % | Fluoride ppm | Coupon initial wt. gm | Coupon final wt. gm | Coupon weight loss gm | Corrosion Rate (mil/yr) |
|---|---|---|---|---|---|---|---|---|---|---|
| 41 | 6061-T6 Aluminum | 64 | 100 | 97.9 | 2.1 | 30(NaF) | 2.4980 | 2.4869 | 0.0111 | 10.4 |
| 42 | 6061-T6 Aluminum | 64 | 100 | 97.9 | 2.1 | 30(NaF) | 2.5147 | 2.5053 | 0.0094 | 9.1 |
| 39 | 6061-T6 Aluminum | 94 | 100 | 95.2 | 4.8 | -0- | 2.3540 | 2.1103 | 0.2442 | 168 |
| 40 | 6061-T6 Aluminum | 94 | 100 | 95.2 | 4.8 | -0- | 2.4673 | (Extension Coupon Corrosion) | | |
| 37 | 6061-T6 Aluminum | 93 | 100 | 95.2 | 4.8 | 300(NaF) | 2.4282 | 2.3540 | 0.0742 | 50.1 |
| 38 | 6061-T6 Aluminum | 93 | 100 | 95.2 | 4.8 | 300(NaF) | 2.4622 | 2.3840 | 0.0782 | 51.9 |
| 27 | 6061-T6 Aluminum | 0.2 | 100 | 88.3 | 11.7 | -0- | 2.2292 | (Coupon Dissolved) | | |
| 28 | 6061-T6 Aluminum | 0.2 | 100 | 88.3 | 11.7 | -0- 2.4586 | (Coupon Dis-solved) | | | |
| 29 | 6061-T6 Aluminum | 0.2 | 100 | 88.3 | 11.7 | -0- | 2.4891 | (Coupon Dissolved) | | |
| 31 | 6061-T6 Aluminum | 89 | 100 | 90 | 10 | 300(NaF) | 1.7005 | (Coupon Dissolved) | | |
| 32 | 6061-T6 Aluminum | 89 | 100 | 90 | 10 | 300(NaF) | 2.4934 | (Coupon Dissolved) | | |
| 33 | 6061-T6 Aluminum | 2 | 100 | 90 | 10 | 300(NaF) | 2.5131 | 1.7823 | (Coupon Badly Pitted) | |
| 34 | 6061-T6 Aluminum | 2 | 100 | 90 | 10 | 300(NaF) | 2.5320 | 1.9293 | (Coupon Badly Pitted) | |
| 35 | 6061-T6 Aluminum | 42 | 100 | 90 | 10 | 3000(NaF) | 2.4521 | 2,4282 | (Localized Corrosion) | |
| 36 | 6061-T6 Aluminum | 42 | 100 | 90 | 10 | 3000(NaF) | 2.4686 | 2.4622 | 0.0064 | 9.2 |

From an examination of the results of the first set of corrosion tests in Table V, wherein water content of the $H_2SO_4$ solution was 2.1 weight percent, and wherein fluoride concentration was varied from 0 to 30 ppm, it appears that 30 ppm fluoride concentration is not sufficient to impart any substantial corrosion resistance to the aluminum. In the second series of corrosion tests, however, increasing fluoride concentration from 0 to 300 ppm substantially reduced the aluminum corrosion rate from about 168 mils/year to about 50.1 mils per year. This second series employed $H_2SO_4$ solutions containing 4.8 weight percent water.

The third series of corrosion tests employed $H_2SO_4$ solutions containing 11.7 and 10 weight percent water. Tests were performed at 0, 300 and 3000 ppm fluoride in the acid solution. With no fluoride present in the $H_2SO_4$ solution, the aluminum coupons rapidly dissolved within 0.2 hrs. At a level of 300 ppm fluoride in the $H_2SO_4$ solution, aluminum coupons were badly pitted at the end of 2 hours. However, at the 300 ppm fluoride concentration, the corrosion rate was substantially less than the corrosion rate of 0 ppm fluoride concentration. At a fluoride level of 3000 ppm the rate of aluminum corrosion was greatly reduced to only 9.2 mils per year. One test (Run 35) at the 3000 ppm fluoride level resulted in localized corrosion of the aluminum coupon at the point of attachment to the reactor test vessel. It is thought that this localized corrosion resulted from a faulty connection which left spaces sufficient for formation of concentration cells.

From the above description and examples it is shown that substantial corrosion resistance can be imparted to aluminum in contact with $H_2SO_4$ solutions containing up to at least 20 weight percent water by the addition of minor amounts of fluoride compounds to the $H_2SO_4$ solutions. And, although we have described particular embodiments of our invention, many changes and modifications will be obvious to those skilled in the art. Therefore, only such limitations as appear in the appended claims are intended to restrict the scope of the present invention.

We claim:

1. A method for inhibiting corrosion of aluminum and its alloys in contact with sulfuric acid solutions comprising at least about 68 weight percent $H_2SO_4$ and from about 0 to about 20 weight percent water, which method comprises dissolving fluoride containing compounds in said sulfuric acid solution to provide a fluoride concentration of at least about 300 ppm.

2. The method of claim 1 wherein the fluoride concentration in said sulfuric acid solution is at least 3000 ppm.

3. The method of claim 2 wherein the fluoride containing compound is fluorosulfonic acid.

4. The method of claim 2 wherein the fluoride containing compound is sodium fluoride.

* * * * *